US010629127B2

(12) United States Patent
Wang et al.

(10) Patent No.: US 10,629,127 B2
(45) Date of Patent: Apr. 21, 2020

(54) DRIVING METHOD OF DISPLAY DEVICE AND DISPLAY DEVICE

(71) Applicant: BOE TECHNOLOGY GROUP CO., LTD., Beijing (CN)

(72) Inventors: Yu Wang, Beijing (CN); Yi Cheng Lin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 36 days.

(21) Appl. No.: 16/048,521

(22) Filed: Jul. 30, 2018

(65) Prior Publication Data

US 2019/0172394 A1 Jun. 6, 2019

(30) Foreign Application Priority Data

Dec. 6, 2017 (CN) ..... 2017 1 1276885

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2320/0233* (2013.01); *G09G 2320/0295* (2013.01)

(58) Field of Classification Search
CPC ..... G09G 3/3208; G09G 3/3258; G09G 2320/0233
See application file for complete search history.

(56) References Cited

U.S. PATENT DOCUMENTS

2013/0127692 A1* 5/2013 Yoon ..... G09G 3/3258 345/80

FOREIGN PATENT DOCUMENTS

| | | | |
|---|---|---|---|
| CN | 102074189 | A | 5/2011 |
| CN | 103236237 | A | 8/2013 |
| CN | 103903561 | A | 7/2014 |
| CN | 104637444 | A | 5/2015 |
| CN | 105741761 | A | 7/2016 |
| CN | 105761677 | A | 7/2016 |
| CN | 105913801 | A | 8/2016 |
| CN | 106935192 | A | 7/2017 |
| CN | 106991969 | A | 7/2017 |
| KR | 20140140736 | A | 12/2014 |
| KR | 20150077171 | A | 7/2015 |

OTHER PUBLICATIONS

First Office Action for Chinese Patent Application No. 201711276885.8 dated Apr. 1, 2019.

* cited by examiner

*Primary Examiner* — Kent W Chang
*Assistant Examiner* — Chayce R Bibbee
(74) *Attorney, Agent, or Firm* — Calfee, Halter & Griswold LLP

(57) ABSTRACT

The present disclosure provides a driving method of a display device and a display device. The driving method includes: sensing threshold voltages of the driving transistors of the plurality of pixel units and calculating an external compensation value for display data signal according to the threshold voltages of the driving transistors of the plurality of pixel units; performing an internal compensation on the threshold voltage of the driving transistor through the pixel driving circuit; and superimposing the external compensation value and the display data signal, wherein a data signal obtained by the superimposing is input into the pixel driving circuit for driving the light emitting element to emit light.

10 Claims, 3 Drawing Sheets

DRIVING METHOD OF DISPLAY DEVICE AND DISPLAY DEVICE

CROSS-REFERENCE

The present application is based upon and claims priority to Chinese Patent Application No. 201711276885.8, filed on Dec. 6, 2017, and the entire contents thereof are incorporated herein by reference.

TECHNICAL FIELD

The present disclosure relates to the field of display technology, in particular, to a driving method of a display device and a display device.

BACKGROUND

Compared with the liquid crystal display device in the conventional technology, the organic light emitting diode (OLED) display device has the characteristics of fast response, excellent color purity and brightness, high contrast, wide viewing angle, and the like.

Generally, the OLED display devices can be classified into passive matrix OLED (PMOLED) display devices and active matrix OLED (AMOLED) display devices according to driving methods thereof.

The structure and driving method of the PMOLED display device are relatively simple, which makes the PMOLED display device easy to be manufactured, but the PMOLED's resolution and size are limited. Therefore, the PMOLED display devices are generally relatively small and are often used to display characters and small icons.

The AMOLED is driven by a thin film transistor (TFT) including a storage capacitor, so that a large-sized and high-resolution display panel can be realized. The AMOLED display devices can be made much larger than the PMOLED display devices and are not limited by size and resolution. Therefore, the AMOLED display devices are considered to be the development direction of future display technologies.

For the AMOLED display device, currents flowing through the OLED at different time for the same image data voltage are different due to factors such as instability of the driving transistor and aging of the OLED, resulting in uneven display brightness of the entire display panel. These problems are difficult to completely be overcome in the process, so they are solved by various compensation techniques.

The compensation method can be divided into internal compensation and external compensation. The internal compensation refers to a compensation method through a sub-circuit built by using thin-film transistors inside a pixel. The external compensation refers to a method of sensing electrical or optical characteristics of a pixel through an external driving circuit or device and then performing compensation. Generally, the compensation range of the internal compensation is too small to cover the characteristic change of the transistor. Although the compensation range of the external compensation is wide, it is easy to generate a compensation mura, and the compensation timeliness is poor.

It should be noted that the information disclosed in the foregoing background section is only for enhancement of understanding of the background of the present disclosure and therefore may include information that does not constitute the prior art that is already known to those of ordinary skill in the art.

SUMMARY

The present disclosure provides a driving method of a display device and a display device.

According to one aspect of the present disclosure, there is provided a driving method of a display device including a plurality of pixel units, each of the pixel units including a pixel driving circuit having a driving transistor and a light emitting element coupled to the pixel driving circuit. The driving method includes: sensing threshold voltages of the driving transistors of the plurality of pixel units and calculating an external compensation value for display data signal according to the threshold voltages of the driving transistors of the plurality of pixel units; performing an internal compensation on the threshold voltage of the driving transistor through the pixel driving circuit; and superimposing the external compensation value and the display data signal, wherein a data signal obtained by the superimposing is input into the pixel driving circuit for driving the light emitting element to emit light.

In an embodiment of the present disclosure, the step of sensing threshold voltages of the driving transistors of the plurality of pixel units and calculating an external compensation value for display data signal according to the threshold voltages of the driving transistors of the plurality of pixel units may be performed when image data is not displayed.

In an embodiment of the present disclosure, the step of sensing threshold voltages of the driving transistors of the plurality of pixel units and calculating an external compensation value for display data signal according to the threshold voltages of the driving transistors of the plurality of pixel units may be performed in a blank display interval or when power is off.

In an embodiment of the present disclosure, the driving transistor includes a first terminal, a second terminal and a control terminal coupled to a first node, a power supply voltage and a second node respectively, and the first node is coupled to the light emitting element. The pixel driving circuit further includes: a first switch unit configured to control turning on and off between a data line and the second node; a second switch unit configured to control turning on and off between a sensing line and the first node; and a capacitor coupled between the first node and the second node. The step of performing an internal compensation on the threshold voltage of the driving transistor through the pixel driving circuit may include: turning on the first switch unit and the second switch unit to apply a first reference voltage to the second node through the data line and a second reference voltage to the first node through the sensing line, thereby resetting a voltage of the second node; and maintaining the first switch unit to be turned on and turning off the second switch unit, to keep applying the first reference voltage to the second node through the data line, thereby compensating the threshold voltage of the driving transistor.

In an embodiment of the present disclosure, inputting the data signal obtained by the superimposing to the pixel driving circuit for driving the light emitting element to emit light may include: maintaining the first switch unit to be turned on and the second switch unit to be turned off, to apply the data signal obtained by superimposing to the second node through the data line; and turning off the first switch unit to drive the light emitting element to emit light.

In an embodiment of the present disclosure, the second reference voltage may be 0 v.

In an embodiment of the present disclosure, the step of sensing threshold voltages of the driving transistors of the plurality of pixel units may include: turning on the first switch unit to apply a sensing voltage through the data line; and maintaining the first switch unit to be turned on and turning on the second switch unit to charge the sense line, thereby obtaining the threshold voltages of the driving transistors.

According to another aspect of the present disclosure, there is provided a display device including a plurality of pixel units, each of the pixel units comprising a pixel driving circuit having a driving transistor and a light emitting element coupled to the pixel driving circuit. The display device further includes: a sensing module, configured to sense threshold voltages of the driving transistors of the plurality of pixel units and calculate an external compensation value for display data signal according to the threshold voltages of the driving transistors of the plurality of pixel units; a control module, configured to control the pixel driving circuit to perform an internal compensation on the threshold voltage of the driving transistor; and a superimposing module, configured to superimpose the external compensation value and the display data signal, wherein a data signal obtained by superimposing is input into the pixel driving circuit for driving the light emitting element to emit light.

In an embodiment of the present disclosure, the driving transistor includes a first terminal, a second terminal and a control terminal coupled to a first node, a power supply voltage and a second node respectively, and the first node is coupled to the light emitting element. The pixel driving circuit further includes: a first switch unit configured to control turning on and off between a data line and the second node; a second switch unit configured to control turning on and off between a sensing line and the first node; and a capacitor coupled between the first node and the second node.

In an embodiment of the present disclosure, the control module is configured to: turn on the first switch unit and the second switch unit to apply a first reference voltage to the second node through the data line and a second reference voltage to the first node through the sensing line, thereby resetting a voltage of the second node; and maintain the first switch unit to be turned on and turn off the second switch unit, to keep applying the first reference voltage to the second node through the data line, thereby compensating the threshold voltage of the driving transistor.

In an embodiment of the present disclosure, the superimposing module is configured to: maintain the first switch unit to be turned on and the second switch unit to be turned off, to apply the data signal obtained by superimposing to the second node through the data line; and turn off the first switch unit to drive the light emitting element to emit light.

In an embodiment of the present disclosure, the sensing module is configured to: turn on the first switch unit to apply a sensing voltage through the data line; and maintain the first switch unit to be turned on and turn on the second switch unit to charge the sense line, thereby obtaining the threshold voltages of the driving transistors.

BRIEF DESCRIPTION OF THE DRAWINGS

The accompanying drawings are included herein to provide further understanding of the present disclosure. The accompanying drawings, which are incorporated in and constitute a part of this description, illustrate embodiments of the present disclosure, and together with the description serve to explain the principles of the present disclosure. Obviously, the drawings in the following description are merely some embodiments of the present disclosure, and those skilled in the art can also obtain other drawings based on these drawings without any creative work. In the drawing.

DETAILED DESCRIPTION

Exemplary embodiments of the present disclosure will now be described more fully with reference to the accompanying drawings. However, the exemplary embodiments can be implemented in various forms and should not be construed as limited to the examples set forth herein; rather, these embodiments are provided so that this disclosure will be more complete and thorough, and will fully convey the concept of the present disclosure to those skilled in the ar. The features, structures, or characteristics described may be combined in any suitable manner in one or more embodiments.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Hereinafter, a driving method of a display device and a display device of the present disclosure will be explained in detail with reference to the accompanying drawings.

Firstly, according to an exemplary embodiment of the present disclosure, a driving method of a display device is provided.

Figure 1:
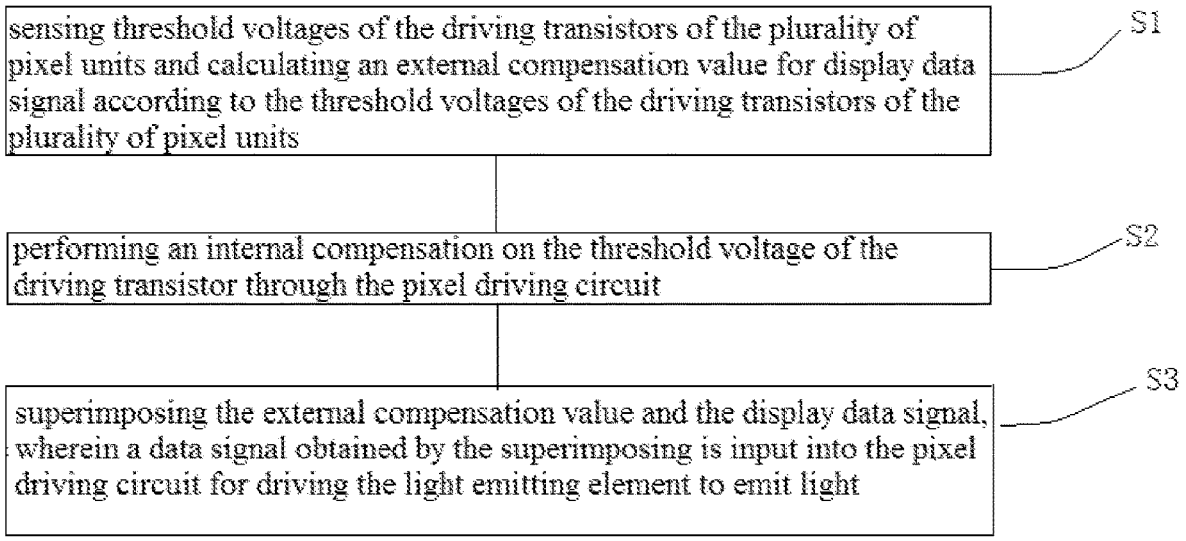
FIG. 1 schematically illustrates a flowchart of a driving method of a display device according to an exemplary embodiment of the present disclosure.

FIG. 1 schematically illustrates a flowchart of a driving method of a display device according to an exemplary embodiment of the present disclosure.

According to an exemplary embodiment of the present disclosure, the display device may be an organic light emitting diode display device, and may include a plurality of pixel units. Each pixel unit includes a pixel driving circuit and a light emitting element coupled to the pixel driving circuit, and the pixel driving circuit includes a driving transistor. Here, the light emitting element may be an organic light emitting diode.

As shown in FIG. 1, the driving method may include: in step S1, sensing threshold voltages of the driving transistors of the plurality of pixel units and calculating an external compensation value for display data signal according to the threshold voltages of the driving transistors of the plurality of pixel units; in step S2, performing an internal compensation on the threshold voltage of the driving transistor through the pixel driving circuit; and in step S3, superimposing the external compensation value and the display data signal, wherein a data signal obtained by the superimposing is input into the pixel driving circuit for driving the light emitting element to emit light.

As described above, according to the driving method of display device in the embodiment, the driving transistor of the pixel unit is internally compensated by the pixel driving circuit, and the display data signal is externally compensated according to the threshold voltages of the driving transistors of the plurality of pixel units. Therefore, the compensation effect of the pixel unit can be improved, thereby improving the brightness uniformity of the display device.

According to an exemplary embodiment of the present disclosure, the sensing threshold voltages and calculating an external compensation value for display data signal as a part of external compensation may be performed when image data is not displayed, for example in a blank display interval or when power is off.

The above steps will be explained in detail below by taking the pixel driving circuit shown in FIG. 2 as an example.

Figure 2:
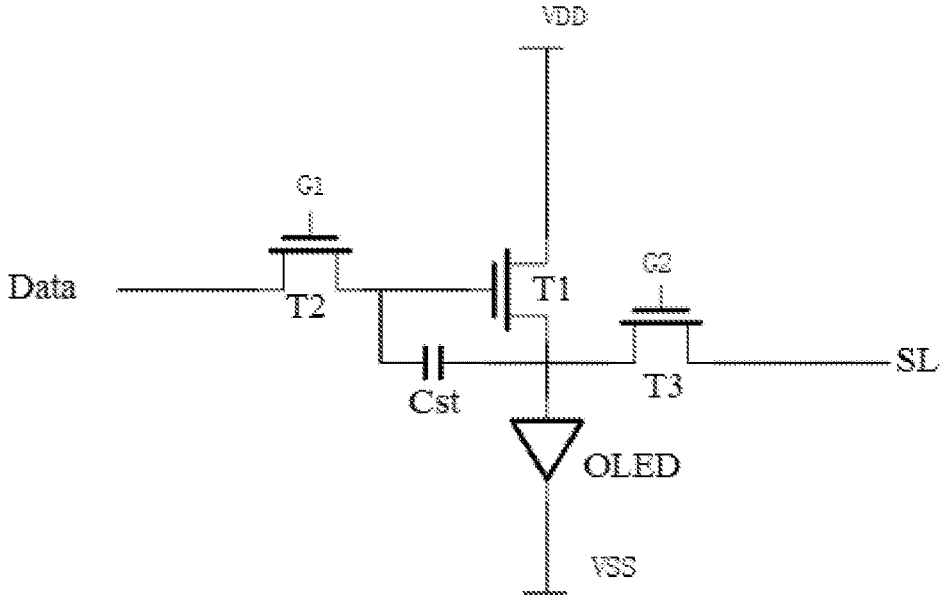
FIG. 2 schematically illustrates a circuit diagram of a pixel driving circuit of a pixel unit of a display device according to an exemplary embodiment of the present disclosure.

FIG. 2 schematically illustrates a circuit diagram of a pixel driving circuit of a pixel unit of a display device according to an exemplary embodiment of the present disclosure.

As shown in FIG. 2, the pixel unit may include an organic light emitting diode OLED and a pixel driving circuit.

The organic light emitting diode OLED may include an anode electrode, a hole transport layer, an organic light emitting layer, an electron transport layer, and a cathode electrode. When a voltage is applied to the anode electrode and the cathode electrode of the organic light emitting diode OLED, holes and electrons are respectively transmitted to the organic light emitting layer through the hole transport layer and the electron transport layer, and recombined in the organic light emitting layer to emit light. The anode of the organic light emitting diode OLED may be coupled to the first node N1 of the pixel driving circuit, and the cathode thereof may be coupled to the low level voltage VSS (e.g., ground).

The pixel driving circuit may include a first transistor (driving transistor) T1, a first switch unit, a second switch unit, and a capacitor Cst. In FIG. 1, the first switch unit and the second switch unit are shown as a second transistor T2 and a third transistor T3, respectively. However, those skilled in the art will recognize that the first switch unit and the second switch unit are not limited to transistors, and any structure and/or circuit capable of achieving their respective functions can be used as the first switch unit and the second switch unit.

The first transistor T1 provides a driving current to the organic light emitting diode OLED. A first terminal, second terminal, and control terminal (gate) of the first transistor T1 may be coupled to a first node N1, a power supply voltage VDD, and a second node N2, respectively.

The second transistor T2 as the first switch unit controls the turning on and off between a data line Data and the second node N2, and a first terminal, second terminal, and control terminal (gate) of the second transistor T2 can be respectively coupled to the data line Data, the second node N2 and a scan line G1, so that the second transistor T2 is turned on and off under the control of first control signal from the scan line G1.

The third transistor T3 as the second switch unit controls the turning on and off between the sensing line SL and the first node N1, and a first terminal, second terminal, and control terminal (gate) of the third transistor T3 can be respectively coupled to the first node N1, the sensing line SL, and the control line G2, so that the third transistor T3 is turned on and off under the control of a second control signal from the control line G2.

The capacitor Cst is coupled between the first node N1 and the second node N2. That is, the plates of the capacitor Cst may be coupled to the first node N1 and the second node N2, respectively, to buffer and maintain the data voltage.

The first transistor T1, the second transistor T2, and the third transistor T3 may be NMOS type transistors, however, the present disclosure is not limited thereto.

The steps S1-S3 will be described below with reference to FIG. 1 in conjunction with the pixel driving circuit shown in FIG. 2.

Step S1

According to an exemplary embodiment of the present disclosure, the method of sensing threshold voltages of the driving transistors of the plurality of pixel units is not particularly limited. For example, the threshold voltage of the driving transistor may be sensed by the pixel driving circuit shown in FIG. 2.

The sensing the threshold voltage of the driving transistor using the pixel driving circuit shown in FIG. 2 will be described below with reference to FIGS. 2 and 3.

Figure 3:
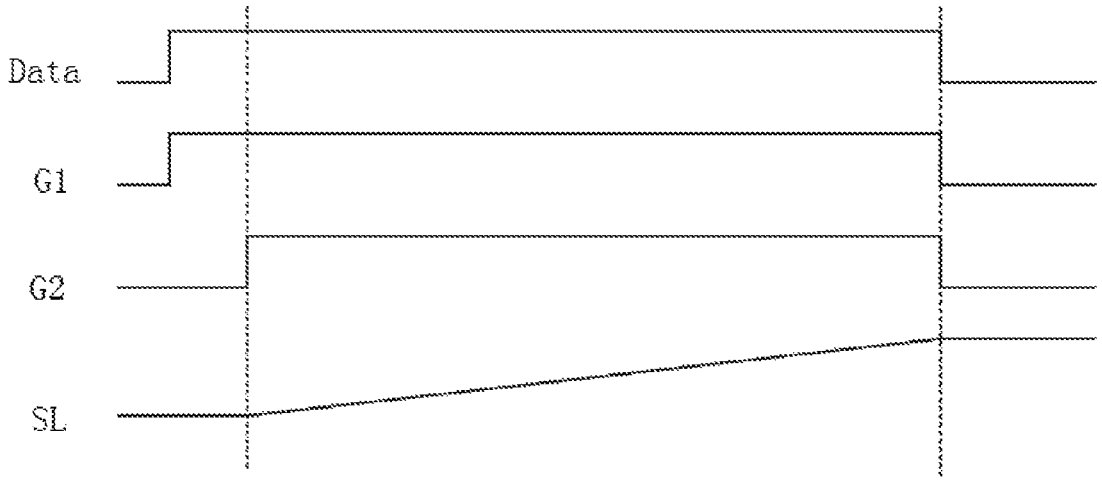
FIG. 3 is a timing diagram of sensing a threshold voltage of a driving transistor by a pixel driving circuit according to an exemplary embodiment of the present disclosure.

FIG. 3 is a timing diagram of sensing a threshold voltage of a driving transistor by a pixel driving circuit according to an exemplary embodiment of the present disclosure.

As shown in FIGS. 2 and 3, the second transistor T2 is turned on, and the sensing voltage is applied through the data line Data. Then, the second transistor T2 is kept being turned on, and the third transistor T3 is turned on to charge the sensing line SL, thereby obtaining a threshold voltage Vth=Vdata−Vs of the first transistor T1, where Vdata is the sensing voltage applied through the data line, and Vs is the voltage of the first node N1.

After the threshold voltages of the driving transistors of the plurality of pixel units are sensed, the distribution of the threshold voltages Vth of the driving transistors of the pixel units on the entire display panel can be obtained. In this case, a mathematical model can be established based on the obtained threshold voltages Vth to calculate a compensation value to be superimposed to the display data signal.

For example, an external compensation value, that is, the compensation value to be superimposed to the display data signal, can be calculated by the following mathematical model.

$$\text{Compensation value} = \begin{cases} x_1 & x \le -3 \\ x_1 + s_1 * (x+3) & -3 < x \le -2 \\ x_2 + s_2 * (x+2) & -2 < x \le -1 \\ x_3 + s_3 * (x+1) & -1 < x \le 0 \\ x_4 + s_4 * x & 0 < x \le 1 \\ x_5 + s_5 * (x-1) & 1 < x \le 2 \\ x_6 + s_6 * (x-2) & 2 < x \le 3 \\ x_7 & x > 3 \end{cases}$$

In the above formula, s1 to s6 are compensation coefficients, and x1 to x7 are constants. Since the compensation value is gradually accumulated as the threshold voltage Vth increases, x1 to x7 are the accumulation of the maximum compensation value of the previous stage.

Figure 4:
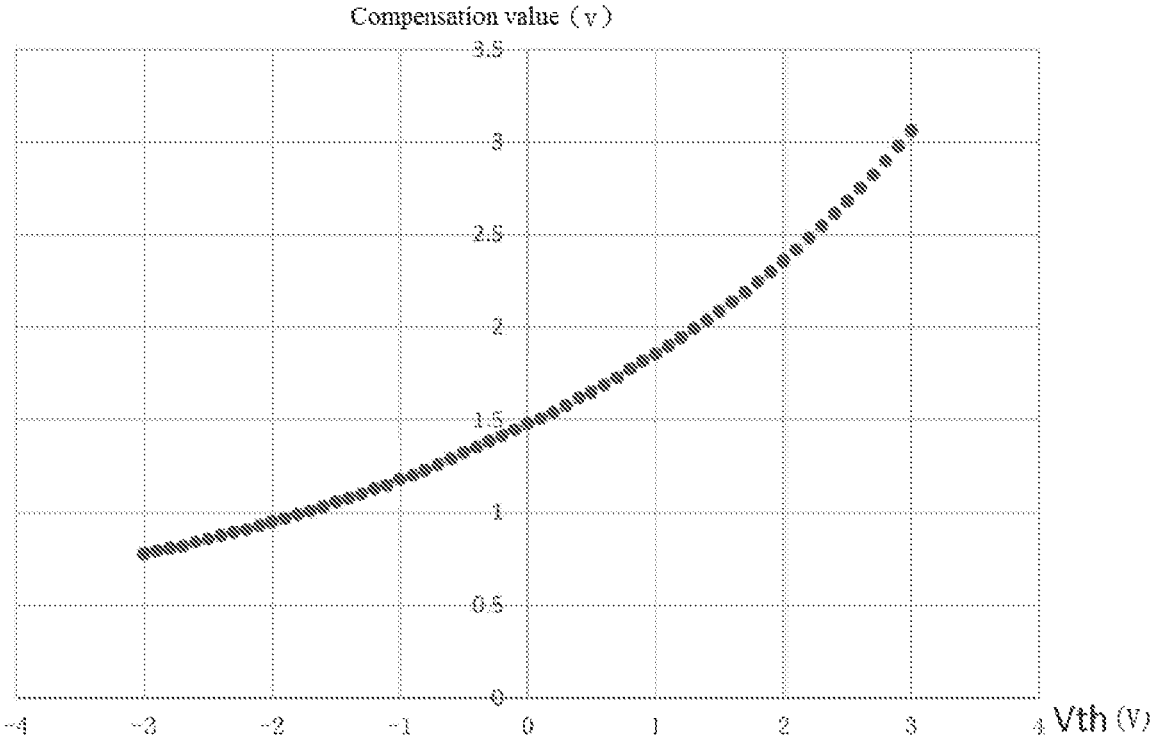
FIG. 4 is a graph of a compensation value for a display data signal as a function of a threshold voltage according to an exemplary embodiment of the present disclosure.

Now, an example, in which the sensed threshold voltages Vth over the entire panel are in the range of −1 to 0, will be described. Firstly, an initial compensation coefficient and constant are determined based on the graph of the compensation value as a function of the threshold voltage shown in FIG. 4. Then, the compensation coefficient and constant are adjusted to achieve the best compensation effect. The compensation coefficient and constant when the best compensation effect is achieved by adjusting are used as s3 and x3. Similarly, the compensation coefficients and constants of the other ranges of the threshold voltage Vth can be determined according to the graph of FIG. 4, thereby obtaining a compensation formula for the range of −3 to 3. The compensation value for the display data signal can be determined by putting the sensed threshold voltage Vth into the obtained compensation formula.

Although a specific mathematical model for calculating the external compensation value is described above, the present disclosure is not limited thereto, and any mathematical model capable of calculating the compensation value for display data signal according to threshold voltages of driving transistors of a plurality of pixel units can be applied in the present disclosure.

Step S2

The step of performing an internal compensation on the threshold voltage of the driving transistor through the pixel driving circuit will be described below with reference to FIGS. 2 and 5.

Figure 5:
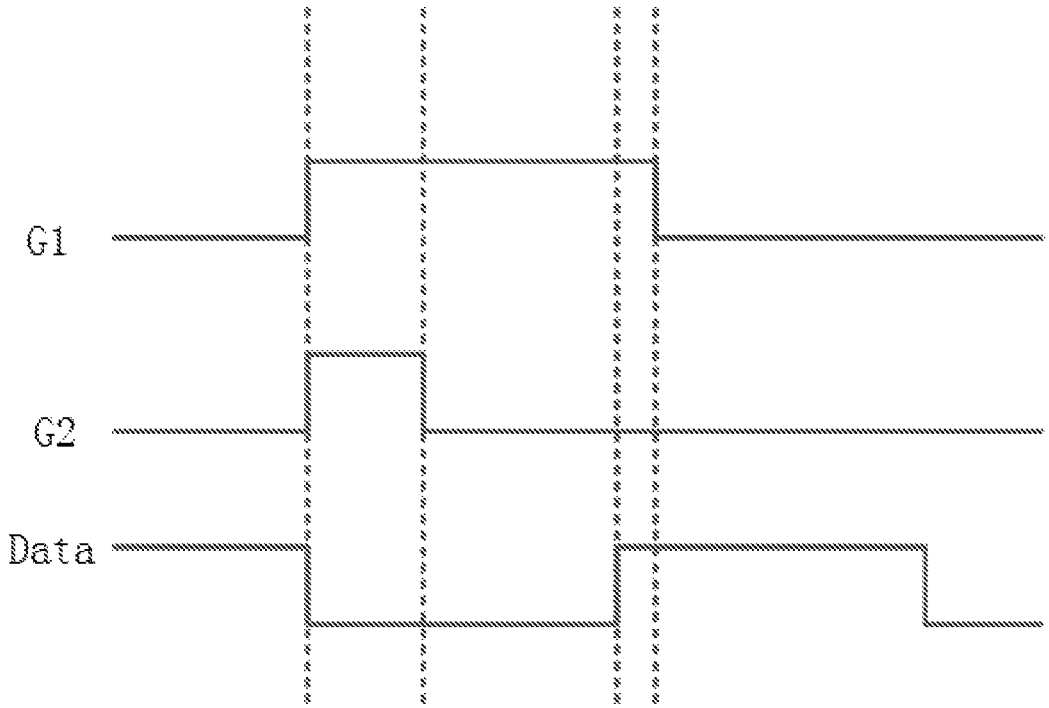
FIG. 5 schematically illustrates a driving timing diagram of a pixel driving circuit according to an exemplary embodiment of the present disclosure.

FIG. 5 schematically illustrates a driving timing diagram of a pixel driving circuit according to an exemplary embodiment of the present disclosure.

As shown in FIGS. 2 and 5, the second transistor T2 as the first switch unit and the third transistor T3 as the second switch unit are turned on, and the first reference voltage and the second reference voltage are respectively applied to the second node N2 and the first node N1 through the data line Data and the sensing line SL, so as to perform a resetting operation. According to an exemplary embodiment of the present disclosure, the second reference voltage from the sensing line SL may be set to be 0 v.

Then, the second transistor T2 is maintained to be turned on and the third transistor T3 is turned off, and the first reference voltage is continuously applied to the second node N2 through the data line Data, to compensate the threshold voltage of the driving transistor T1 so as to achieve internal compensation.

Step S3

The external compensation value for the display data signal calculated in step S1 is superimposed to the display data signal. Here, the external compensation value for the display data signal obtained when the image data is not displayed in step S1 may be stored in advance. Then, in the displaying stage, the external compensation value for the display data signal stored in advance and the display data signal are superimposed, and the data signal obtained by superimposing is used as the driving voltage data signal that drives the organic light emitting diode OLED to emit light. That is, the superimposed data signal is input to the pixel driving circuit for driving the organic light emitting diode MED to emit light.

Inputting the superimposed data signal to the pixel driving circuit to drive the organic light emitting diode OLED to emit light will be exemplarily described with reference to FIGS. 2 and 5. As shown in FIGS. 2 and 5, the second transistor T2 is maintained to be turned on and the third transistor T3 is maintained to be turned off, and the superimposed data signal is applied to the second node N2 through the data line Data. Then, the second transistor T2 is turned off, so that the voltage of the first node N1 is increased to the lighting voltage to drive the organic light emitting diode to emit light.

In addition, according to an embodiment of the present disclosure, there is provided a display device.

Figure 6:
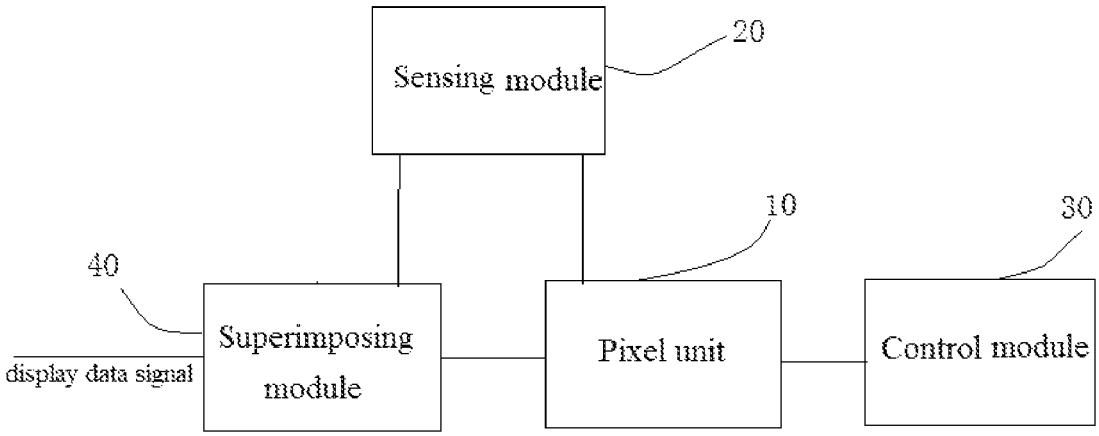
FIG. 6 schematically illustrates a block diagram of a display device according to an exemplary embodiment of the present disclosure.

FIG. 6 schematically illustrates a block diagram of a display device according to an exemplary embodiment of the present disclosure.

As shown in FIG. 6, the display device includes a plurality of pixel units 10. Each of the pixel units 10 includes a pixel driving circuit having a driving transistor and a light emitting element coupled to the pixel driving circuit.

The display device further includes: a sensing module 20, sensing threshold voltages of the driving transistors of the plurality of pixel units 10 and calculating an external compensation value for display data signal according to the threshold voltages of the driving transistors of the plurality of pixel units 10; a control module 30, controlling the pixel driving circuit to perform an internal compensation on the threshold voltage of the driving transistor; and a superimposing module 40, superimposing the external compensation value and the display data signal, wherein a data signal obtained by superimposing is input into the pixel driving circuit for driving the light emitting element to emit light.

According to an embodiment of the present disclosure, the pixel unit 10 may include the pixel driving circuit as shown in FIG. 2. In particular, the pixel unit 10 may include an organic light emitting diode OLED and a pixel driving circuit. The pixel driving circuit may include a first transistor (driving transistor) T1, a second transistor T2 as a first switch unit, a third transistor T3 as a second switch unit, and a capacitor Cst. For this, please refer to the above detailed description made with reference to FIG. 2.

The sensing module 20 may turn on the first switch unit (e.g., the second transistor T2) to apply a sensing voltage through the data line Data; and maintain the first switch unit (e.g., the second transistor T2) to be turned on and turn on the second switch unit (e.g., the third transistor T3) to charge the sense line SL, thereby obtaining the threshold voltages of the driving transistors T1. For this, please refer to the above detailed description of step S1.

The control module 30 may turn on the first switch unit (e.g., the second transistor T2) and the second switch unit (e.g., the third transistor T3) to apply a first reference voltage to the second node N2 through the data line Data and a second reference voltage to the first node N1 through the sensing line SL, thereby resetting a voltage of the second node N2; and maintain the first switch unit (e.g., the second transistor T2) to be turned on and turn off the second switch unit (e.g., the third transistor T3), to keep applying the first reference voltage to the second node N2 through the data line Data, thereby compensating the threshold voltage of the driving transistor T1. For this, please refer to the above detailed description of step S2.

The superimposing module 40 may maintain the first switch unit (e.g., the second transistor T2) to be turned on and the second switch unit (e.g., the third transistor T3) to be turned off, to apply the data signal obtained by superimposing to the second node N2 through the data line Data; and turn off the first switch unit (e.g., the second transistor T2) to drive the light emitting element (i.e., the organic light emitting diode OLED) to emit light. For this, please refer to the above detailed description of step S3.

As used herein, the terms "sensing module", "control module", and "superimposing module" refer to one or more processing circuits such as an application specific integrated circuit (ASIC), an electronic circuit, a processor (shared, dedicated, or group) and memory that executes one or more software or firmware programs, a combinational logic circuit, and/or other suitable components that provide the described functionality. As can be appreciated, these modules can be combined and/or further partitioned.

According to the display device in the embodiment of the present disclosure, the driving transistor of the pixel unit is internally compensated by the pixel driving circuit, and the display data signal is externally compensated according to the threshold voltages of the driving transistors of the plurality of pixel units. Therefore, the compensation effect of the pixel unit can be improved, thereby improving the brightness uniformity of the display device.

The specific exemplary embodiments of the present disclosure have been described above. These exemplary embodiments are not intended to be exhaustive or restrictive. It will be apparent that many modifications and variations can be made by those skilled in the art in light of the above teachings. Therefore, the scope of the present disclosure is not intended to be limited to the foregoing embodiments, but is intended to be defined by the claims and their equivalents.

What is claimed is:

1. A driving method of a display device comprising a plurality of pixel units, each of the pixel units comprising a pixel driving circuit having a driving transistor and a light emitting element coupled to the pixel driving circuit, the driving method comprising:

sensing threshold voltages of the driving transistors of the plurality of pixel units and calculating an external compensation value for display data signal according to the threshold voltages of the driving transistors of the plurality of pixel units;

performing an internal compensation on the threshold voltage of the driving transistor through the pixel driving circuit; and superimposing the external compensation value and the display data signal, wherein a data signal obtained by the superimposing is input into the pixel driving circuit for driving the light emitting element to emit light, wherein the driving transistor comprises a first terminal, a second terminal and a control terminal coupled to a first node, a power supply voltage and a second node respectively, and the first node is coupled to the light emitting element, wherein the pixel driving circuit further comprises:

a first switch unit, configured to control turning on and off between a data line and the second node;

a second switch unit, configured to control turning on and off between a sensing line and the first node; and a capacitor, coupled between the first node and the second node, wherein the step of performing an internal compensation on the threshold voltage of the driving transistor through the pixel driving circuit comprises:

turning on the first switch unit and the second switch unit to apply a first reference voltage to the second node through the data line and a second reference voltage to the first node through the sensing line, thereby resetting a voltage of the second node; and maintaining the first switch unit to be turned on and turning off the second switch unit, to keep applying the first reference voltage to the second node through the data line, thereby compensating the threshold voltage of the driving transistor.

2. The driving method of a display device according to claim 1, wherein the step of sensing threshold voltages of the driving transistors of the plurality of pixel units and calculating an external compensation value for display data signal according to the threshold voltages of the driving transistors of the plurality of pixel units is performed when image data is not displayed.

3. The driving method of a display device according to claim 1, wherein the step of sensing threshold voltages of the driving transistors of the plurality of pixel units and calculating an external compensation value for display data signal according to the threshold voltages of the driving transistors of the plurality of pixel units is performed in a blank display interval.

4. The driving method of a display device according to claim 1, wherein the step of sensing threshold voltages of the driving transistors of the plurality of pixel units and calculating an external compensation value for display data signal according to the threshold voltages of the driving transistors of the plurality of pixel units is performed when power is off.

5. The driving method of a display device according to claim 1, wherein the step of inputting the data signal obtained by the superimposing to the pixel driving circuit for driving the light emitting element to emit light comprises:

maintaining the first switch unit to be turned on and the second switch unit to be turned off, to apply the data signal obtained by superimposing to the second node through the data line; and turning off the first switch unit to drive the light emitting element to emit light.

6. The driving method of a display device according to claim 1, wherein the second reference voltage is 0 v.

7. The driving method of a display device according to claim 1, wherein the step of sensing threshold voltages of the driving transistors of the plurality of pixel units comprises:

turning on the first switch unit to apply a sensing voltage through the data line; and maintaining the first switch unit to be turned on and turning on the second switch unit to charge the sense line, thereby obtaining the threshold voltages of the driving transistors.

8. A display device comprising a plurality of pixel units, each of the pixel units comprising a pixel driving circuit having a driving transistor and a light emitting element coupled to the pixel driving circuit, wherein the display device further comprising:

a sensing module, configured to sense threshold voltages of the driving transistors of the plurality of pixel units and to calculate an external compensation value for display data signal according to the threshold voltages of the driving transistors of the plurality of pixel units;

a control module, configured to control the pixel driving circuit to perform an internal compensation on the threshold voltage of the driving transistor; and a superimposing module, configured to superimpose the external compensation value and the display data signal, wherein a data signal obtained by superimposing is input into the pixel driving circuit for driving the light emitting element to emit light, wherein the driving transistor comprises a first terminal, a second terminal and a control terminal coupled to a first node, a power supply voltage and a second node respectively, and the first node is coupled to the light emitting element, and wherein the pixel driving circuit further comprises:

a first switch unit, configured to control turning on and off between a data line and the second node;

a second switch unit, configured to control turning on and off between a sensing line and the first node; and a capacitor, coupled between the first node and the second node, wherein the control module is configured to:

turn on the first switch unit and the second switch unit to apply a first reference voltage to the second node through the data line and a second reference voltage to the first node through the sensing line, thereby resetting a voltage of the second node; and maintain the first switch unit to be turned on and turn off the second switch unit, to keep applying the first reference voltage to the second node through the data line, thereby compensating the threshold voltage of the driving transistor.

9. The display device according to claim 8, wherein the superimposing module is configured to:

maintain the first switch unit to be turned on and the second switch unit to be turned off, to apply the data signal obtained by superimposing to the second node through the data line; and turn off the first switch unit to drive the light emitting element to emit light.

10. The display device according to claim 8, wherein the sensing module is configured to:

turn on the first switch unit to apply a sensing voltage through the data line; and maintain the first switch unit to be turned on and turn on the second switch unit to charge the sense line, thereby obtaining the threshold voltages of the driving transistors.

* * * * *